US010632519B2

(12) United States Patent
Wen et al.

(10) Patent No.: US 10,632,519 B2
(45) Date of Patent: Apr. 28, 2020

(54) MANUFACTURING METHOD AND APPARATUS FOR USB INTERFACE METAL CASING

(71) Applicant: SHENZHEN TATFOOK QUAINTFAB CO., LTD, Shenzhen, Guangdong (CN)

(72) Inventors: Jie Wen, Guangdong (CN); Zijian He, Guangdong (CN)

(73) Assignee: SHENZHEN TATFOOK QUAINTFAB CO., LTD., Shenzhen, Guangdong (CN)

( * ) Notice: Subject to any disclaimer, the term of this patent is extended or adjusted under 35 U.S.C. 154(b) by 406 days.

(21) Appl. No.: 15/540,918

(22) PCT Filed: Dec. 31, 2014

(86) PCT No.: PCT/CN2014/095794
§ 371 (c)(1),
(2) Date: Jun. 29, 2017

(87) PCT Pub. No.: WO2016/106633
PCT Pub. Date: Jul. 7, 2016

(65) Prior Publication Data

US 2017/0348756 A1 Dec. 7, 2017

(51) Int. Cl.
*B21D 51/02* (2006.01)
*H01R 43/16* (2006.01)
*H01R 13/50* (2006.01)

(52) U.S. Cl.
CPC ..... *B21D 51/02* (2013.01); *H01R 13/50* (2013.01); *H01R 43/16* (2013.01)

(58) Field of Classification Search
CPC ..... B21D 51/02; B21D 39/08; B21D 41/02; B21D 41/04; H01R 13/50; B21C 37/15; B21C 37/155; B21C 37/16
(Continued)

(56) References Cited

U.S. PATENT DOCUMENTS 3,413,945 A * 12/1968 Bertoglio ..... B21C 1/26 401/209
4,606,214 A * 8/1986 Miyazaki ..... B21D 41/02 72/313

(Continued)

FOREIGN PATENT DOCUMENTS

CN 1721097 A 1/2006
CN 201295722 Y 8/2009

(Continued)

OTHER PUBLICATIONS

Khvashchuk, "EternalCase—metal case for flash drive & other small things", https://www.kickstarter.com/projects/952731033/eternalcase-metal-case-for-flash-drive-and-other-s (Year: 2012).*

*Primary Examiner* — Adam J Eiseman
*Assistant Examiner* — Bobby Yeonjin Kim
(74) *Attorney, Agent, or Firm* — Andrew C. Cheng

(57) ABSTRACT

The present disclosure provides a manufacturing method and a manufacturing apparatus for an USB interface metal casing. The manufacturing method for an USB interface metal casing includes: feeding a flat-shaped pipe blank to a lower mold (S100); closing a first upper mold and the lower mold, and performing pipe-expansion forming to a bottom of the pipe blank (S110); closing a second upper mold and the lower mold, and performing necking and chamfering to a top port of the pipe blank (S120); and closing a third upper mold and the lower mold, and modifying the pipe blank to obtain a final finished product of the USB interface metal casing (S130).

20 Claims, 5 Drawing Sheets

(58) Field of Classification Search
USPC ..... 72/368, 381–383, 394–398, 370.06, 72/370.1, 370.12
See application file for complete search history.

(56) References Cited

U.S. PATENT DOCUMENTS

| | | | | | |
|---|---|---|---|---|---|
| 5,582,054 | A * | 12/1996 | Yoshino | B21D 17/02 | 72/306 |
| 6,447,399 | B1 * | 9/2002 | Denham | B21K 1/60 | 470/28 |
| 10,135,191 | B1 * | 11/2018 | Ahn | G06F 21/556 | |
| 2004/0080989 | A1 * | 4/2004 | Yu | G06F 1/1632 | 365/200 |
| 2007/0074557 | A1 * | 4/2007 | Takada | B21D 53/16 | 72/370.1 |
| 2009/0205393 | A1 * | 8/2009 | Mehta | B21D 51/02 | 72/370.12 |
| 2010/0193064 | A1 * | 8/2010 | Takada | B21C 37/0803 | 138/156 |
| 2012/0295497 | A1 | 11/2012 | Li | | |

FOREIGN PATENT DOCUMENTS

| | | | |
|---|---|---|---|
| CN | 102263351 | A | 11/2011 |
| CN | 102327972 | A | 1/2012 |
| CN | 202137266 | U | 2/2012 |
| CN | 202137266 | U | 2/2012 |
| CN | 102672041 | A | 9/2012 |
| CN | 103441365 | A | 12/2013 |
| CN | 103531981 | A | 1/2014 |

* cited by examiner

MANUFACTURING METHOD AND APPARATUS FOR USB INTERFACE METAL CASING

TECHNICAL FIELD

Embodiments of the present disclosure generally relate to USB interface metal casing manufacturing processes technology, and in particular relate to a manufacturing method and a manufacturing apparatus for an USB interface metal casing.

BACKGROUND

A bending structure previously used in an USB interface metal casing is gradually replaced by an integrated structure. However, in the prior art, a customer generally has a need for designing a fillet R at a port of an USB interface metal casing having an integrated structure. The fillet, especially the fillet at the port, is commonly formed by firstly forming a contour of the USB interface metal casing by stamping forming, then forming a port of the USB interface metal casing by punching process; the remaining portion is then used as the fillet. The manufacturing method has drawbacks that the processes are complicated, the shrinkage of the materials at the fillet is uneven, and additional processes such as burring or the like are needed to perform to the port after punching, and thus it is impossible to obtain the USB interface metal casing meeting the size requirements for one time.

SUMMARY

The technical problem to be solved by the present disclosure is to provide a manufacturing method and a manufacturing apparatus for an USB interface metal casing, which can solve the technical problems in the art that the processes are complicated, the shrinkage of the materials at the fillet is uneven, and additional processes such as burring or the like are needed to perform to the port after punching, and thus it is impossible to obtain the USB interface metal casing meeting the size requirements for one time.

In order to solve the above-mentioned problems, the present disclosure provides a manufacturing method for an USB interface metal casing. The method includes: feeding a flat-shaped pipe blank to a lower mold; closing a first upper mold and the lower mold, and performing pipe-expansion forming to a bottom of the pipe blank; closing a second upper mold and the lower mold, and performing necking and chamfering to a top port of the pipe blank; and closing a third upper mold and the lower mold, and modifying the pipe blank to obtain a final finished product of the USB interface metal casing.

In one embodiment of the present disclosure, the lower mold includes a lower mold base, a stripper arranged on the lower mold base, a stripper urging element penetrating through the lower mold base and abutted against the stripper, and a lower mold core penetrating through the stripper and further connected to the lower mold base; the pipe blank is sleeved on the lower mold core; the stripper urging element urge the stripper to separates the USB interface metal casing processed in the lower mold core from the lower mold core.

In one embodiment of the present disclosure, the first upper mold includes a first upper mold base, a pipe-pressing element connected to a bottom surface of the first upper mold base, and a pipe-expanding element connected to the first upper mold base via an elastic element; the pipe-expanding element is provided with a pipe-expanding cavity configured to cooperate with the lower mold core to accomplish the pipe expanding process, and the elastic element penetrates through the pipe-pressing element; wherein during the closing process of the first upper mold and the lower mold, the pipe-expanding element firstly contacts with the stripper, and the first upper mold gradually closes to the lower mold; the elastic element is compressed, and the pipe-pressing element presses downwardly onto the top of the pipe blank to make the bottom of the pipe blank enter a gap defined by the lower mold core and the pipe-expanding element, and the pipe expansion process is achieved.

In one embodiment of the present disclosure, the second upper mold includes a second upper mold base, a necking element connected to a bottom surface of the second upper mold base, and a necking inner core penetrating through the necking element and further connected to the second upper mold base via an elastic element; a forming cavity in shape of a fillet is defined in the necking element; wherein during the closing of the second upper mold and the lower mold, the necking inner core is firstly abutted against the lower mold core, the necking element presses downwardly in such a way that an inner wall of the fillet-shaped forming cavity of the necking element contacts with the top port of the pipe blank, and the top port of the pipe blank is necked and chamfered.

In one embodiment of the present disclosure, one end of the necking inner core abutted against the lower mold core is provided with a boss, and an outer contour of the boss is the same as an inner contour of the necked chamfer end of the finished product of the USB interface metal casing; the boss is configured to limit the dimension of the inner contour of the necked chamfer end during the necking and chamfering process performed by the necking element.

In one embodiment of the present disclosure, the second upper mold includes a middle protection element arranged at a bottom of the necking element, and a side pressing block is arranged inside the middle protection element; the side pressing block is urged to connect to the second upper mold base via an urging block penetrating through the necking element, and is configured to apply side pressure to two sides of the pipe blank during the necking and chamfering processes performed by the necking element, thereby preventing the pipe blank from deforming laterally.

In one embodiment of the present disclosure, a contact surface formed by the side pressing block and the urging block is a slanted surface with a preset slant angle.

In one embodiment of the present disclosure, the second upper mold further includes a pipe-expansion shaping element arranged at a bottom of the middle protection element and further connected to the second upper mold base via the elastic element; the elastic element penetrates through the middle protection element and the necking element; the pipe-expansion shaping element is configured to sleeve on the circumference of the pipe-expansion portion of the pipe blank to maintain the outer contour of the pipe-expansion portion of the pipe blank during the necking and chamfering processes In one embodiment of the present disclosure, the second upper mold includes a second guiding connection post penetrating through the necking element, the middle protection element and the pipe-expansion shaping element, and further connected to the second upper mold base; the second guiding connection post is configured to guide the pipe-expansion shaping element.

In one embodiment of the present disclosure, constructional elements of the third upper mold correspond to those of the second upper mold; the dimension of the contour of the forming cavity of the necking element and/or the pipe-expansion shaping element of the third upper mold is slightly different from that of the necking element and/or the pipe-expansion shaping element of the second upper mold; by modifying the tolerance of the forming cavity of the second upper mold, the third upper mold modifies the dimension of the pipe blank before the forming of the pipe blank.

In one embodiment of the present disclosure, the first upper mold further includes a first guiding connection post penetrating through the pipe-pressing element and the pipe-expanding element, and further connected to the first upper mold base; the first guiding connection post is configured to guide the pipe-pressing element.

In one embodiment of the present disclosure, the first upper mold further includes a first connection element arranged between the pipe-pressing element and the first upper mold base and configured to connect the pipe-pressing element to the first upper mold base.

In one embodiment of the present disclosure, the first upper mold further includes a first restricting plate located on two opposite sides of the first upper mold and connected to the first upper mold base; the first restricting plate is in shape of an "⊏" having an opening towards the pipe-pressing element; an upper end of the first restricting plate is connected to the first upper mold base, and a lower end of the first restricting plate is hooked around a bottom of the pipe-expanding element; the first restricting plate is configured to restrict the maximum displacement of the pipe-expanding element along the first guiding connection post.

In one embodiment of the present disclosure, the elastic element is a spring.

In order to solve the above-mentioned problems, the present disclosure also provides a manufacturing apparatus for an USB interface metal casing. The manufacturing apparatus includes: a lower mold, a first upper mold, a second upper mold and a third upper mold; the first upper mold and the lower mold are closed to perform pipe-expansion forming to a bottom of the pipe blank; the second upper mold and the lower mold are closed to perform necking and chamfering to a top port of the pipe blank; the third upper mold and the lower mold are closed to modify the pipe blank to obtain a final finished product of a USB interface metal casing.

In one embodiment of the present disclosure, the lower mold includes a lower mold base, a stripper arranged on the lower mold base, a stripper urging element penetrating through the lower mold base and abutted against the stripper, and a lower mold core penetrating through the stripper and further connected to the lower mold base; the pipe blank is sleeved on the lower mold core; the stripper urging element urge the stripper to separates the USB interface metal casing processed in the lower mold core from the lower mold core.

In one embodiment of the present disclosure, the first upper mold includes a first upper mold base, a pipe-pressing element connected to a bottom surface of the first upper mold base, and a pipe-expanding element connected to the first upper mold base via an elastic element; the pipe-expanding element is provided with a pipe-expanding cavity configured to cooperate with the lower mold core to accomplish the pipe expanding process, and the elastic element penetrates through the pipe-pressing element; wherein during the closing process of the first upper mold and the lower mold, the pipe-expanding element firstly contacts with the stripper, and the first upper mold gradually closes to the lower mold; the elastic element is compressed, and the pipe-pressing element presses downwardly onto the top of the pipe blank to make the bottom of the pipe blank enter a gap defined by the lower mold core and the pipe expanding cavity of the pipe-expanding element, and the pipe expansion process is achieved.

In one embodiment of the present disclosure, the second upper mold includes a second upper mold base, a necking element connected to a bottom surface of the second upper mold base, and a necking inner core penetrating through the necking element and further connected to the second upper mold base via an elastic element; a forming cavity in shape of a fillet is defined in the necking element; wherein during the closing of the second upper mold and the lower mold, the necking inner core is firstly abutted against the lower mold core, the necking element presses downwardly in such a way that an inner wall of the fillet-shaped forming cavity of the necking element contacts with the top port of the pipe blank, and the top port of the pipe blank is necked and chamfered.

In one embodiment of the present disclosure, one end of the necking inner core abutted against the lower mold core is provided with a boss, and an outer contour of the boss is the same as an inner contour of the necked chamfer end of the finished product of the USB interface metal casing; the boss is configured to limit the dimension of the inner contour of the necked chamfer end during the necking and chamfering process performed by the necking element.

In one embodiment of the present disclosure, the second upper mold includes a middle protection element arranged at a bottom of the necking element, and a side pressing block is arranged inside the middle protection element; the side pressing block is urged to connect to the second upper mold base via an urging block penetrating through the necking element, and is configured to apply side pressure to two sides of the pipe blank during the necking and chamfering processes performed by the necking element, thereby preventing the pipe blank from deforming laterally.

In one embodiment of the present disclosure, a contact surface formed by the side pressing block and the urging block is a slanted surface with a preset slant angle.

In one embodiment of the present disclosure, the second upper mold further includes a pipe-expansion shaping element arranged at a bottom of the middle protection element and further connected to the second upper mold base via the elastic element; the elastic element penetrates through the middle protection element and the necking element; the pipe-expansion shaping element is configured to sleeve on the circumference of the pipe-expansion portion of the pipe blank to maintain the outer contour of the pipe-expansion portion of the pipe blank during the necking and chamfering processes In one embodiment of the present disclosure, the second upper mold includes a second guiding connection post penetrating through the necking element, the middle protection element and the pipe-expansion shaping element, and further connected to the second upper mold base; the second guiding connection post is configured to guide the pipe-expansion shaping element.

In one embodiment of the present disclosure, constructional elements of the third upper mold correspond to those of the second upper mold; the dimension of the contour of the forming cavity of the necking element and/or the pipe-expansion shaping element of the third upper mold is slightly different from that of the necking element and/or the pipe-expansion shaping element of the second upper mold; by modifying the tolerance of the forming cavity of the second upper mold, the third upper mold modifies the dimension of the pipe blank before the forming of the pipe blank.

In one embodiment of the present disclosure, the first upper mold further includes a first guiding connection post penetrating through the pipe-pressing element and the pipe-expanding element, and further connected to the first upper mold base; the first guiding connection post is configured to guide the pipe-pressing element.

In one embodiment of the present disclosure, the first upper mold further includes a first connection element arranged between the pipe-pressing element and the first upper mold base and configured to connect the pipe-pressing element to the first upper mold base.

In one embodiment of the present disclosure, the first upper mold further includes a first restricting plate located on two opposite sides of the first upper mold and connected to the first upper mold base; the first restricting plate is in shape of an "⊏" having an opening towards the pipe-pressing element; an upper end of the first restricting plate is connected to the first upper mold base, and a lower end of the first restricting plate is hooked around a bottom of the pipe-expanding element; the first restricting plate is configured to restrict the maximum displacement of the pipe-expanding element along the first guiding connection post.

In one embodiment of the present disclosure, the elastic element is a spring.

In the manufacturing method and the manufacturing apparatus for a USB interface metal casing provided in this embodiment, three closing processes are used, and thus the USB interface metal casing may be capable of performing closing respectively with three upper molds on one lower mold station, in order to complete processes including pipe expansion, necking and chamfering and modifying; in this way, the USB interface metal casing which meets the requirement of dimension can be obtained for one time. Compared with the manufacturing method for a USB interface metal casing in the art, the method provided in the present disclosure is simple, the material at the fillet of the USB interface metal casing has uniform shrinkage, and there is no need to perform additional processes, such as burring or the like, to the finished USB interface metal casing.

BRIEF DESCRIPTION OF THE DRAWINGS

In order to make the technical solution described in the embodiments of the present disclosure more clearly, the drawings used for the description of the embodiments will be briefly described. Apparently, the drawings described below are only parts of the embodiments of the present disclosure; one skilled in the art may obtain other drawings based on these drawings, without making any inventive work.

DETAILED DESCRIPTION

The technical solutions in the embodiments of the present disclosure will be clearly and completely described in connection with the drawings in the embodiments of the present disclosure. Obviously, the described embodiments are merely parts of the embodiments of the present disclosure, not all embodiments. Based on the embodiments in the present disclosure, all other embodiments can be obtained by those skilled in the art without making any creative work are within the scope of the protection of the present disclosure.

Figure 1:
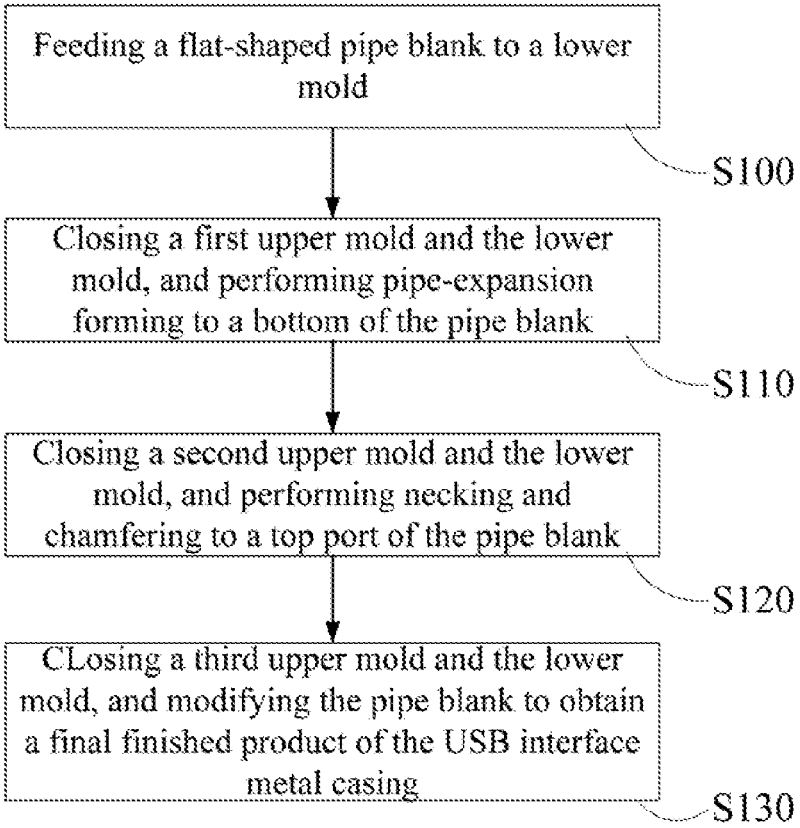
FIG. 1 is a flow chart of a manufacturing method for an USB interface metal casing according to an embodiment of the present disclosure.

Referring to FIG. 1, a flow chart of a manufacturing method for an USB interface metal casing according to an embodiment of the present disclosure is depicted. The manufacturing method for an USB interface metal casing may include the following blocks.

At block S100: feeding a flat-shaped pipe blank to a lower mold.

At block S110: closing a first upper mold and the lower mold, and performing pipe-expansion forming to a bottom of the pipe blank.

At block S120: closing a second upper mold and the lower mold, and performing necking and chamfering to a top port of the pipe blank.

At block S130: closing a third upper mold and the lower mold, and modifying the pipe blank to obtain a final finished product of the USB interface metal casing.

In the manufacturing method for a USB interface metal casing provided in this embodiment, three closing processes are used, and thus the USB interface metal casing may be capable of performing closing respectively with three upper molds on one lower mold station, in order to complete processes including pipe expansion, necking and chamfering and modifying. In this way, the USB interface metal casing which meets the requirement of dimension can be obtained for one time. Compared with the manufacturing method for a USB interface metal casing in the art, the method provided in the present disclosure is simple, the material at the fillet of the USB interface metal casing has uniform shrinkage, and there is no need to perform additional processes, such as burring or the like, to the finished USB interface metal casing.

Figure 2:
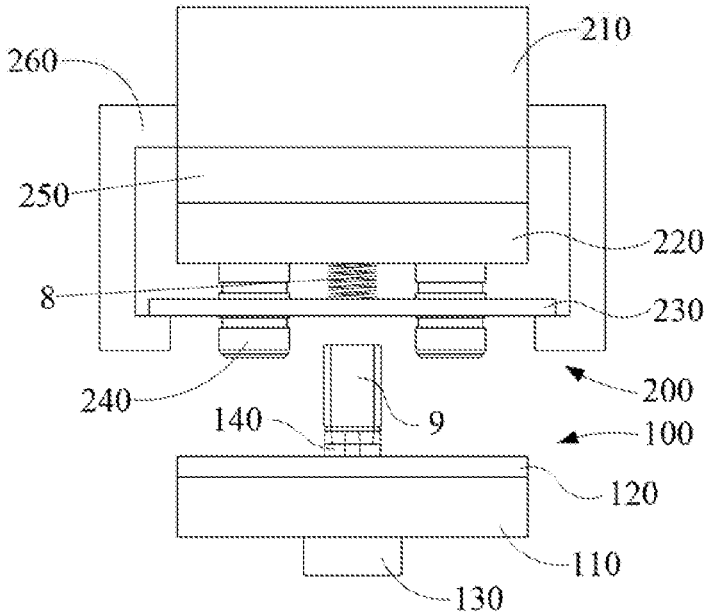
FIG. 2 is a schematic view showing the configuration of a manufacturing apparatus before the first upper mold and the lower mold are closed according to the manufacturing method for an USB interface metal casing shown in the embodiment of FIG. 1.
Figure 3:
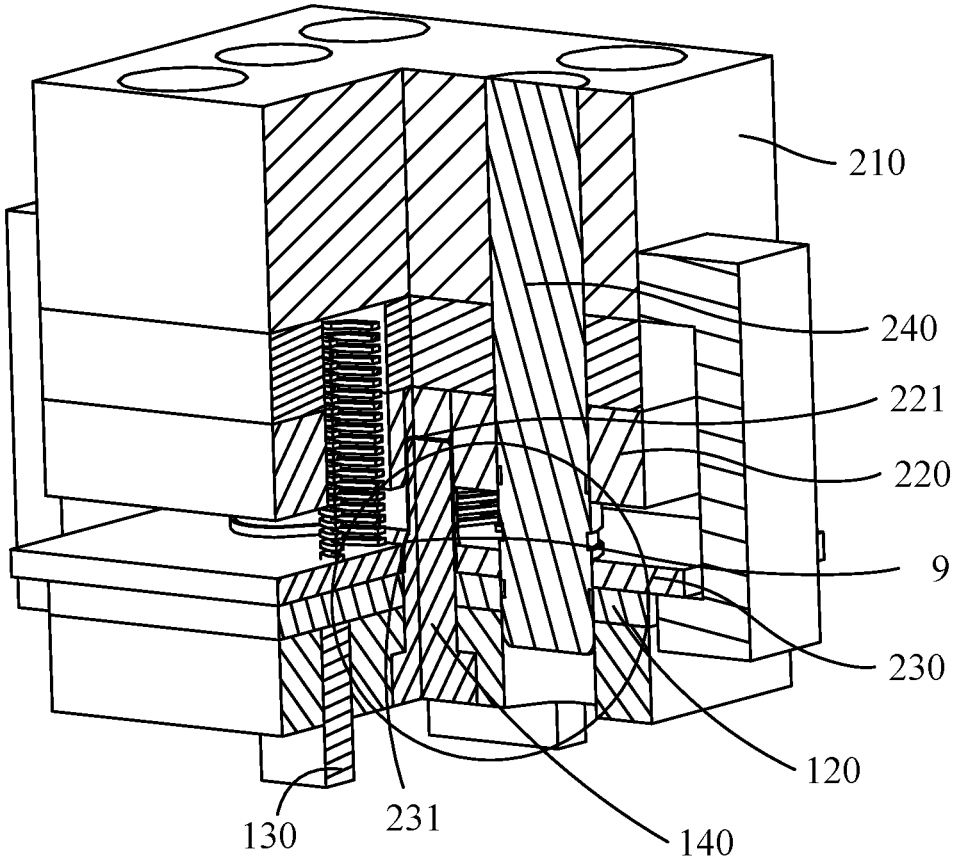
FIG. 3 is a cutaway view showing the configuration of the manufacturing apparatus after the first upper mold and the lower mold are closed according to the manufacturing method for an USB interface metal casing shown in the embodiment of FIG. 1.

The manufacturing method for an USB interface metal casing may be further described in detail in connection with a manufacturing apparatus used in each blocks. Referring to FIG. 2 and FIG. 3, in FIG. 2, a schematic view showing the configuration of a manufacturing apparatus before the first upper mold and the lower mold are closed according to the manufacturing method for an USB interface metal casing shown in the embodiment of FIG. 1 is depicted, while in FIG. 3, a cutaway view showing the configuration of the manufacturing apparatus after the first upper mold and the lower mold are closed according to the manufacturing method for an USB interface metal casing shown in the embodiment of FIG. 1 is depicted.

The lower mold 100 may include a lower mold base 110, a stripper 120, a stripper urging element 130 and a lower mold core 140. Wherein the stripper 120 may be arranged on the lower mold base 110. The stripper urging element 130 may penetrate through the lower mold base 110 and may be further abutted against the stripper 120; the stripper urging element 130 may be configured to separate the USB interface metal casing from the lower mold core 140 after all the processes of the USB interface metal casing are finished. A through-hole cable of exactly receiving the position of the lower mold core 140 having a maximum dimension may be formed in the stripper 120. The stripper urging element 130 may urge the stripper 120 to abut against a bottom of the USB interface metal casing sleeved on the lower mold core 140, and in turn separate the finished USB interface metal casing from the lower mold core 140.

The lower mold core 140 may penetrate through the stripper 120 and may be further connected to the lower mold base 110, while a pipe blank 9 may be sleeved on the lower mold core 140. At block S100, the feeding process is the one during which the pipe blank 9 is sleeved on a certain position of the lower mold core 140.

The first upper mold 200 may include a first upper mold base 210, a pipe-pressing element 220, a pipe-expanding element 230, and a first guiding connection post 240. Wherein the pipe-pressing element 220 may be connected to a bottom surface of the first upper mold base 210. A pipe-pressing cavity 221 having an outer contour dimension slightly larger than one end to be necked of the pipe blank is formed on the pipe-pressing element 220. A bottom surface of the pipe-pressing cavity 221 may be planar, thereby ensuring that the pipe blank 9 encounters an even downward force in the plane.

The pipe-expanding element 230 may be connected to the first upper mold base 210 via an elastic element 8, and the elastic element 8 may penetrate through the pipe-pressing element 220. Optionally, the elastic element 8 may be a spring.

Figure 8:
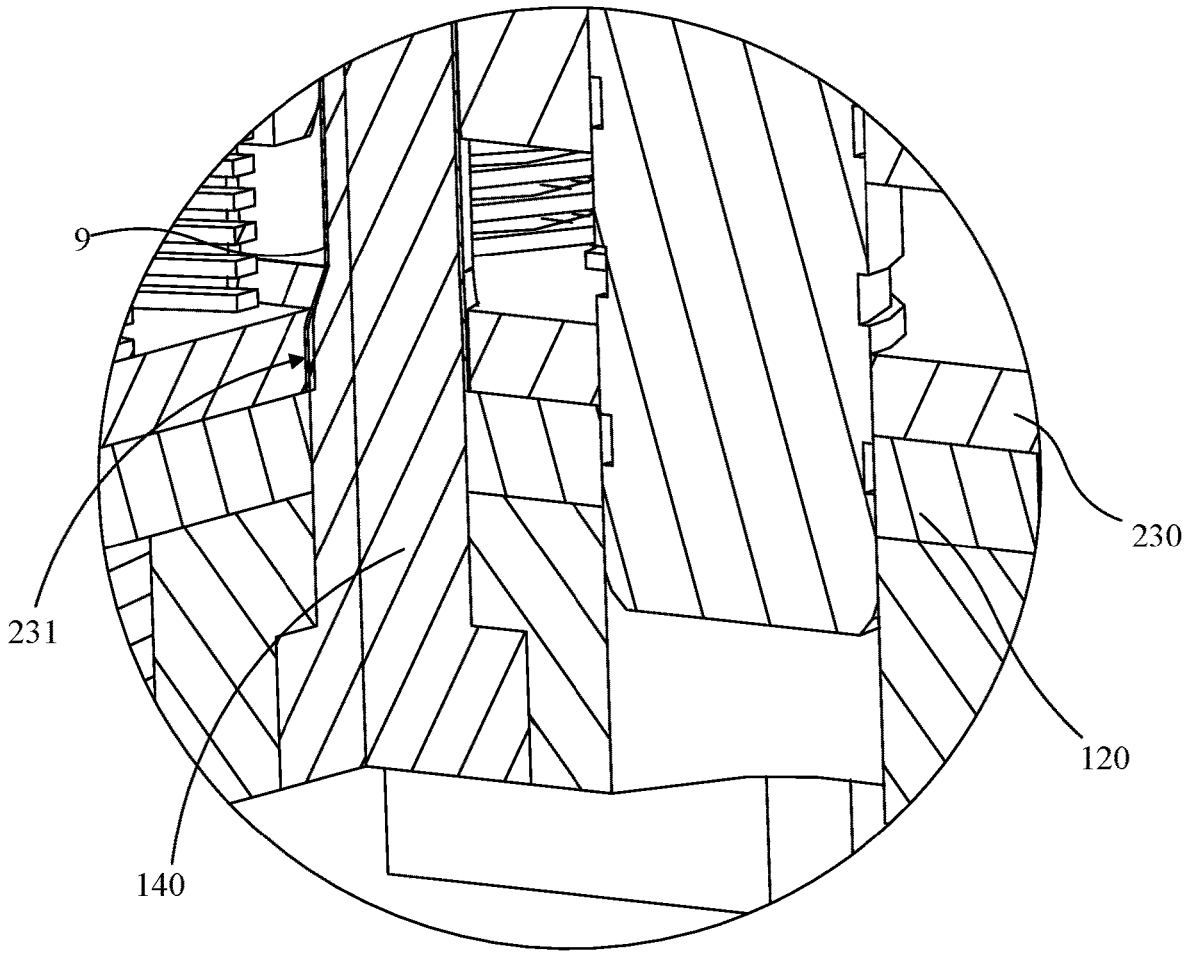
FIG. 8 is an enlarged view of FIG. 3.

As further shown in FIGS. 3 and 8, the pipe-expanding element 230 may be provided with a pipe-expanding cavity 231 configured to cooperate with the lower mold core 140 to accomplish the pipe expanding process. A dimension of the pipe-expanding cavity 231 may be slightly larger than that of the position of the lower mold core 140 where the pipe expands, and may be sleeved on a circumference of the position of the lower mold core 140 where the pipe expands during the closing process. A gap configured to receive a pipe-expanding end of the pipe blank 9 to be processed is further defined by the pipe-expanding element 230 together with the position of the lower mold core 140 where the pipe expands.

Figure 4:
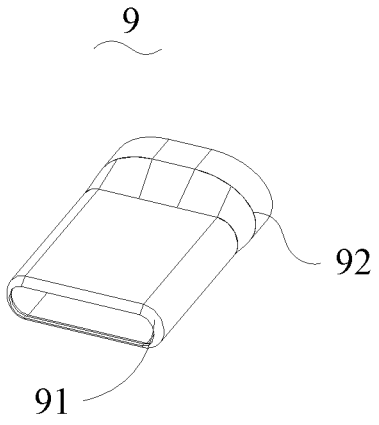
FIG. 4 is a schematic view of the finished product of the USB interface metal casing obtained by the manufacturing method for an USB interface metal casing shown in the embodiment of FIG. 1.

Referring to FIG. 4, a schematic view of the finished product of the USB interface metal casing obtained by the manufacturing method for an USB interface metal casing shown in the embodiment of FIG. 1 is depicted. Wherein numeral 91 of the USB interface metal casing refers to a necked chamfer end, while numeral 92 refers to the pipe-expanding end.

During the closing process of the first upper mold 200 and the lower mold 100, the pipe-expanding element 230 may firstly contact with the stripper 120, and the first upper mold 200 may be continuously getting closer to the lower mold 100. At this time, the elastic element 8 may be compressed, and the pipe-pressing element 220 may press downwardly onto the top of the pipe blank 9 to make the bottom of the pipe blank 9 enter the gap defined by the lower mold core 140 and the pipe-expanding element 230, and the pipe expansion process is then achieved.

The first guiding connection post 240 may penetrate through the pipe-pressing element 220 and the pipe-expanding element 230, and may be further connected to the first upper mold base 210. The first guiding connection post 240 may be configured to guide the pipe-pressing element 230.

Optionally, the first upper mold 200 may further include a first connection element 250 arranged between the pipe-pressing element 220 and the first upper mold base 210 and configured to connect the pipe-pressing element 220 to the first upper mold base 210. The first upper mold 200 may further includes a first restricting plate 260 located on two opposite sides of the first upper mold 200 and connected to the first upper mold case 210. In this embodiment, the first restricting plate 260 may be in shape of an "⊏" having an opening towards an inner side of the manufacturing apparatus, that is, the opening is oriented towards the pipe-expanding element 230. An upper end of the first restricting plate 260 may be connected to the first upper mold base 210, while a lower end thereof may be hooked around a bottom of the pipe-expanding element 230. The first restricting plate 260 may be configured to restrict the maximum displacement of the pipe-expanding element 230 along the first guiding connection post 240.

Figure 5:
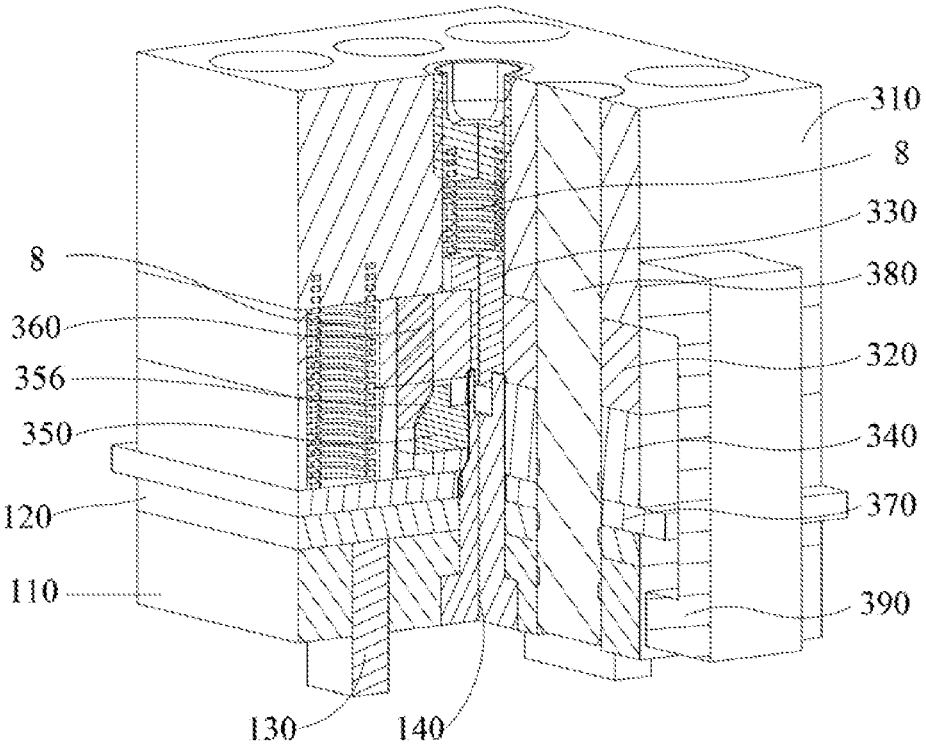
FIG. 5 is a cutaway view showing the configuration of the manufacturing apparatus after the second upper mold and the lower mold are closed according to the manufacturing method for an USB interface metal casing shown in the embodiment of FIG. 1.

Referring to FIG. 5, a cutaway view showing the configuration of the manufacturing apparatus after the second upper mold and the lower mold are closed according to the manufacturing method for an USB interface metal casing shown in the embodiment of FIG. 1 is depicted. The second upper mold 300 may include a second upper mold base 310, a necking element 320 and a necking inner core 330.

Figure 6:
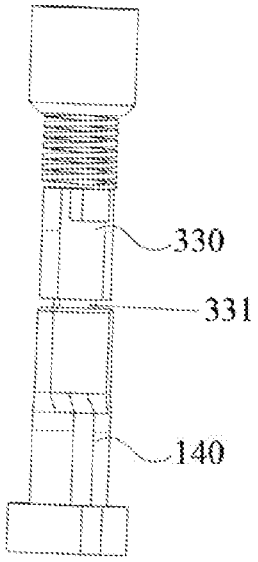
FIG. 6 is a schematic view showing the cooperation of the necking inner core and the lower mold core after the second upper mold and the lower mold are closed shown in the embodiment of FIG. 5.

In specific, the necking element 320 may be connected to a bottom surface of the second upper mold base 310, and the necking inner core 330 may penetrate through the necking element 320 and may be further connected to the second upper mold base 310 via an elastic element 8. Referring to FIG. 6, a schematic view showing the cooperation of the necking inner core and the lower mold core after the second upper mold and the lower mold are closed shown in the embodiment of FIG. 5 is depicted. One end of the necking inner core 330 that is abutted against the lower mold core 140 may be provided with a boss 331, and an outer contour of the boss 331 may be the same as an inner contour of the necked chamfer end 91 of the finished product of the USB interface metal casing. The boss 331 may be configured to limit the dimension of the inner contour of the necked chamfer end during the necking and chamfering process performed by the necking element 320.

Figure 7:
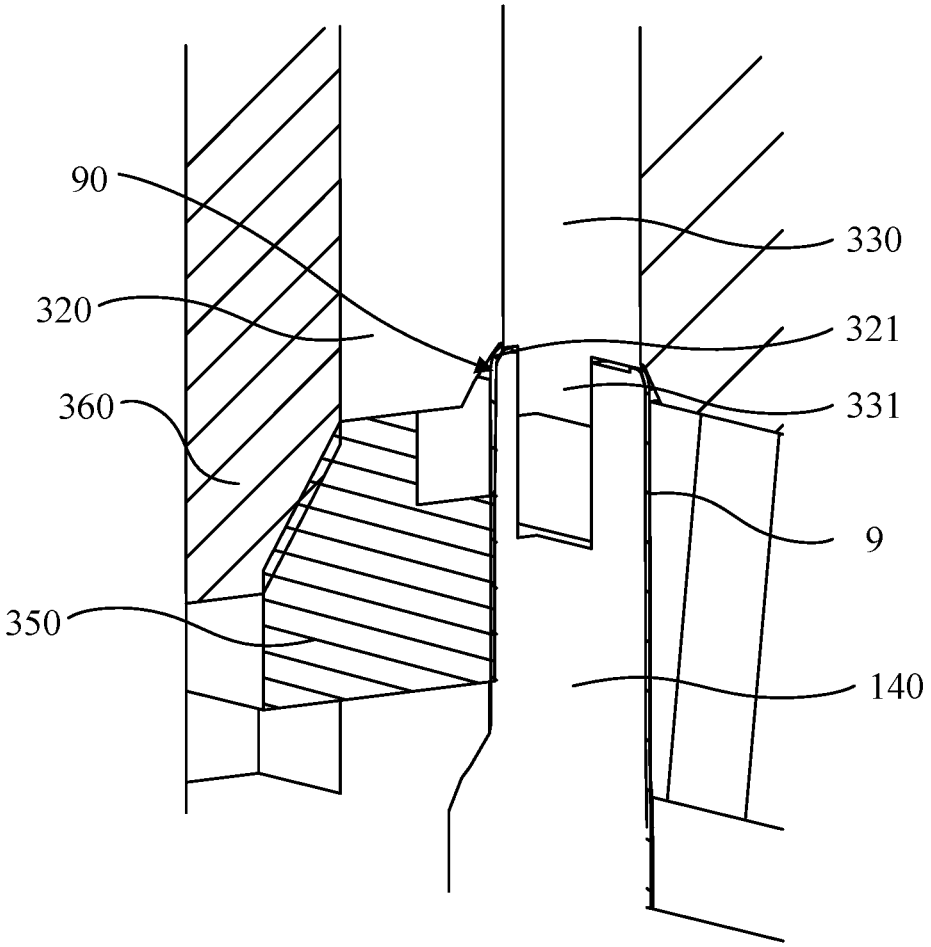
FIG. 7 is a partially enlarged view showing the necking and chamfering of the necking element shown in the embodiment of FIG. 5.

Referring to FIG. 7, a partially enlarged view showing the necking and chamfering of the necking element as is shown in the embodiment of FIG. 5 is depicted. A forming cavity 321 in shape of a fillet may be defined in the necking element 320. During the closing process of the second upper mold 300 and the lower mold 100, the necking inner core 330 may be firstly abutted against the lower mold core 140, the necking element 320 may press downwardly in such a way that an inner wall of the fillet-shaped forming cavity 321 of the necking element 320 may contact with the top port 90 of the pipe blank 9. Then the top port 90 of the pipe blank 9 may be bent along the inner wall of the fillet-shaped forming cavity 321 of the necking element 320 under the pressure of the necking element 320, and finally abutted against the boss 331 arranged at one end of the necking inner core 330 that is abutted against the lower mold core 140. In this way, the necking and chamfering processes of the top port 90 of the pipe blank 9 are finished.

Optionally, the second upper mold 300 may further include a middle protection element 340 arranged at a bottom of the necking element 320, and a side pressing block 350 may be further arranged inside the middle protection element 340. The side pressing block 350 is urged to connect to the second upper mold base 310 via the urging block 360 penetrating through the necking element 320, and is configured to apply side pressure to two sides of the pipe blank 9 during the necking and chamfering processes performed by the necking element 320, thereby preventing the pipe blank 9 from deforming laterally. A contact surface 356 formed by the side pressing block 350 and the urging block 360 is a slanted surface with a preset slant angle. The slant angle is optionally at 45 degrees.

Furthermore, the second upper mold 300 may further include a pipe-expansion shaping element 370 arranged at a bottom of the middle protection element 340 and further connected to the second upper mold base 310 via the elastic element 8. Optionally, the elastic member 8 may be a spring. The pipe-expansion shaping element 370 may be configured to sleeve on the circumference of the pipe-expansion portion of the pipe blank 9 to maintain the outer contour of the pipe-expansion portion of the pipe blank 9 during the necking and chamfering processes. Certainly, it is also possible for the second upper mold 300 to be provided without the pipe-expansion shaping element 370 in case that the necking force and accuracy can be ensured.

As with the first upper mold 200, the second upper mold 300 may include a second guiding connection post 380 penetrating through the necking element 320, the middle protection element 340 and the pipe-expansion shaping element 370, and further connected to the second upper mold base 310. The second upper mold 300 may further include a second restricting plate 390 located on two opposite sides of the second upper mold 300 and further connected to the second upper mold base 310. In this embodiment, the second guiding connection post 380 may be configured to guide the pipe-expansion shaping element 370. The second restricting plate 390 may also be in shape of an "⊏" having an opening towards the inner side, that is, the opening is oriented towards the pipe-expanding shaping element 370. An upper end of the second restricting plate 390 may be connected to the second upper mold base 310, and a lower end thereof may be hooked around a bottom of the pipe-expansion shaping element 370. The second restricting plate 390 may be configured to restrict the maximum displacement of the pipe-expansion shaping element 370 along the second guiding connection post 380.

The constructional elements of the third upper mold correspond to those of the second upper mold 300. In this embodiment, the dimension of the contour of the forming cavity of the necking element and/or the pipe-expansion shaping element of the third upper mold is slightly different from that of the necking element and/or the pipe-expansion shaping element of the second upper mold 300. By modifying the tolerance of the forming cavity of the second upper mold 300, the third upper mold may modify the dimension of the pipe blank before the forming of the pipe blank.

In the manufacturing method and the manufacturing apparatus for a USB interface metal casing provided in this embodiment, three closing processes are used, and thus the USB interface metal casing may be capable of performing closing respectively with three upper molds on one lower mold station, in order to complete processes including pipe expansion, necking and chamfering and modifying. In this way, the USB interface metal casing which meets the requirement of dimension can be obtained for one time. Compared with the manufacturing method for a USB interface metal casing in the art, the method provided in the present disclosure is simple, the material at the fillet of the USB interface metal casing has uniform shrinkage, and there is no need to perform additional processes, such as burring or the like, to the finished USB interface metal casing.

The above description depicts merely some exemplary embodiments of the disclosure, but is meant to limit the scope of the disclosure. Any equivalent structure or flow transformations made to the disclosure, or any direct or indirect applications of the disclosure on other related fields, shall all be covered within the protection of the disclosure.

What is claimed is:

1. A manufacturing method for an USB interface metal casing, comprising:

feeding a flat-shaped pipe blank to a lower mold;

closing a first upper mold and the lower mold, and performing pipe-expansion forming to a bottom of the pipe blank;

closing a second upper mold and the lower mold, and performing necking and chamfering to a top port of the pipe blank; and closing a third upper mold and the lower mold, and modifying the pipe blank to obtain a final finished product of the USB interface metal casing;

wherein the lower mold includes a lower mold base, a stripper arranged on the lower mold base, a stripper urging element penetrating through the lower mold base and abutted against the stripper, and a lower mold core penetrating through the stripper and further connected to the lower mold base; the pipe blank is sleeved on the lower mold core; the stripper urging element urge the stripper to separates the USB interface metal casing processed in the lower mold core from the lower mold core;

the first upper mold includes a first upper mold base, a pipe-pressing element connected to a bottom surface of the first upper mold base, and a pipe-expanding element connected to the first upper mold base via a first elastic element; the pipe-expanding element is provided with a pipe-expanding cavity configured to cooperate with the lower mold core to accomplish the pipe expanding process, and the first elastic element penetrates through the pipe-pressing element; wherein during the closing process of the first upper mold and the lower mold, the pipe-expanding element firstly contacts with the stripper, and the first upper mold gradually closes to the lower mold; the first elastic element is compressed, and the pipe-pressing element presses downwardly onto the top of the pipe blank to make the bottom of the pipe blank enter a gap defined by the lower mold core and the pipe-expanding element, and the pipe expansion process is achieved.

2. The manufacturing method of claim 1, wherein the second upper mold includes a second upper mold base, a necking element connected to a bottom surface of the second upper mold base, and a necking inner core penetrating through the necking element and further connected to the second upper mold base via a second elastic element; a forming cavity in shape of a fillet is formed in the necking element; wherein during the closing of the second upper mold and the lower mold, the necking inner core is firstly abutted against the lower mold core, the necking element presses downwardly in such a way that an inner wall of the fillet-shaped forming cavity of the necking element contacts with the top port of the pipe blank, and the top port of the pipe blank is necked and chamfered.

3. The manufacturing method of claim 2, wherein one end of the necking inner core abutted against the lower mold core is provided with a boss, and an outer contour of the boss is the same as an inner contour of the necked chamfer end of the finished product of the USB interface metal casing; the boss is configured to limit the dimension of the inner contour of the necked chamfer end during the necking and chamfering process performed by the necking element.

4. The manufacturing method of claim 2, wherein the second upper mold includes a middle protection element arranged at a bottom of the necking element, and a side pressing block is arranged inside the middle protection element; the side pressing block is urged to connect to the second upper mold base via an urging block penetrating through the necking element, and is configured to apply side pressure to two sides of the pipe blank during the necking and chamfering processes performed by the necking element, thereby preventing the pipe blank from deforming laterally.

5. A manufacturing apparatus for an USB interface metal casing, comprising a lower mold, a first upper mold, a second upper mold and a third upper mold; the first upper mold and the lower mold are closed to perform pipe-expansion forming to a bottom of a pipe blank; the second upper mold and the lower mold are closed to perform necking and chamfering to a top port of the pipe blank; the third upper mold and the lower mold are closed to modify the pipe blank to obtain a final finished product of a USB interface metal casing;

wherein the lower mold includes a lower mold base, a stripper arranged on the lower mold base, a stripper urging element penetrating through the lower mold base and abutted against the stripper, and a lower mold core penetrating through the stripper and further connected to the lower mold base; the pipe blank is sleeved on the lower mold core; the stripper urging element urge the stripper to separates the USB interface metal casing processed in the lower mold core from the lower mold core;

the first upper mold includes a first upper mold base, a pipe-pressing element connected to a bottom surface of the first upper mold base, and a pipe-expanding element connected to the first upper mold base via a first elastic element; the pipe-expanding element is provided with a pipe-expanding cavity configured to cooperate with the lower mold core to accomplish the pipe expanding process, and the first elastic element penetrates through the pipe-pressing element; wherein during the closing process of the first upper mold and the lower mold, the pipe-expanding element firstly contacts with the stripper, and the first upper mold gradually closes to the lower mold; the first elastic element is compressed, and the pipe-pressing element presses downwardly onto the top of the pipe blank to make the bottom of the pipe blank enter a gap defined by the lower mold core and the pipe-expanding element, and the pipe expansion process is achieved.

6. The manufacturing apparatus of claim 5, wherein the second upper mold includes a second upper mold base, a necking element connected to a bottom surface of the second upper mold base, and a necking inner core penetrating through the necking element and further connected to the second upper mold base via a second elastic element; a forming cavity in shape of a fillet is formed in the necking element; wherein during the closing of the second upper mold and the lower mold, the necking inner core is firstly abutted against the lower mold core, the necking element presses downwardly in such a way that an inner wall of the fillet-shaped forming cavity of the necking element contacts with the top port of the pipe blank, and the top port of the pipe blank is necked and chamfered.

7. The manufacturing apparatus of claim 6, wherein one end of the necking inner core abutted against the lower mold core is provided with a boss, and an outer contour of the boss is the same as an inner contour of the necked chamfer end of the finished product of the USB interface metal casing; the boss is configured to limit the dimension of the inner contour of the necked chamfer end during the necking and chamfering process performed by the necking element.

8. The manufacturing apparatus of claim 6, wherein the second upper mold includes a middle protection element arranged at a bottom of the necking element, and a side pressing block is arranged inside the middle protection element; the side pressing block is urged to connect to the second upper mold base via an urging block penetrating through the necking element, and is configured to apply side pressure to two sides of the pipe blank during the necking and chamfering processes performed by the necking element, thereby preventing the pipe blank from deforming laterally.

9. The manufacturing apparatus of claim 8, wherein a contact surface formed by the side pressing block and the urging block is a slanted surface with a preset slant angle.

10. The manufacturing apparatus of claim 9, wherein the second upper mold further includes a pipe-expansion shaping element arranged at a bottom of the middle protection element and further connected to the second upper mold base via the second elastic element; the second elastic element penetrates through the middle protection element and the necking element; the pipe-expansion shaping element is configured to sleeve on the circumference of the pipe-expansion portion of the pipe blank to maintain the outer contour of the pipe-expansion portion of the pipe blank during the necking and chamfering processes.

11. The manufacturing apparatus of claim 10, wherein the second upper mold includes a second guiding connection post penetrating through the necking element, the middle protection element and the pipe-expansion shaping element, and further connected to the second upper mold; the second guiding connection post is configured to guide the pipe-expansion shaping element.

12. The manufacturing apparatus of claim 11, wherein constructional elements of the third upper mold correspond to those of the second upper mold; a dimension of a contour of a forming cavity of a necking element and a pipe-expansion shaping element of the third upper mold is different from that of the necking element and the pipe-expansion shaping element of the second upper mold; by modifying the tolerance of the forming cavity of the second upper mold, the third upper mold modifies the dimension of the pipe blank before the forming of the pipe blank.

13. The manufacturing apparatus of claim 5, wherein the first upper mold further includes a first guiding connection post penetrating through the pipe-pressing element and the pipe-expanding element, and further connected to the first upper mold base; the first guiding connection post is configured to guide the pipe-pressing element.

14. The manufacturing apparatus of claim 13, wherein the first upper mold further includes a first connection element arranged between the pipe-pressing element and the first upper mold base and configured to connect the pipe-pressing element to the first upper mold base.

15. The manufacturing apparatus of claim 14, wherein the first upper mold further includes a first restricting plate located on two opposite sides of the first upper mold and connected to the first upper mold; the first restricting plate is in shape of an "⊏" having an opening towards the pipe-pressing element; an upper end of the first restricting plate is connected to the first upper mold base, and a lower end of the first restricting plate is hooked around a bottom of the pipe-expanding element; the first restricting plate is configured to restrict the maximum displacement of the pipe-expanding element along the first guiding connection post.

16. The manufacturing apparatus of claim 5, wherein the first elastic element is a spring.

17. A manufacturing apparatus for an USB interface metal casing, comprising a lower mold, a first upper mold, a second upper mold and a third upper mold; the first upper mold and the lower mold are closed to perform pipe-expansion forming to a bottom of a pipe blank; the second upper mold and the lower mold are closed to perform necking and chamfering to a top port of the pipe blank; the third upper mold and the lower mold are closed to modify the pipe blank to obtain a final finished product of a USB interface metal casing;

wherein the lower mold includes a lower mold base, a stripper arranged on the lower mold base, a stripper urging element penetrating through the lower mold base and abutted against the stripper, and a lower mold core penetrating through the stripper and further connected to the lower mold base; the pipe blank is sleeved on the lower mold core; the stripper urging element urge the stripper to separates the USB interface metal casing processed in the lower mold core from the lower mold core;

the second upper mold includes a second upper mold base, a necking element connected to a bottom surface of the second upper mold base, and a necking inner core penetrating through the necking element and further connected to the second upper mold base via an elastic element; a forming cavity in shape of a fillet is formed in the necking element; wherein during the closing of the second upper mold and the lower mold, the necking inner core is firstly abutted against the lower mold core, the necking element presses downwardly in such a way that an inner wall of the fillet-shaped forming cavity of the necking element contacts with the top port of the pipe blank, and the top port of the pipe blank is necked and chamfered.

18. The manufacturing apparatus of claim 17, wherein the first upper mold includes a first upper mold base, a pipe-pressing element connected to a bottom surface of the first upper mold base, and a pipe-expanding element connected to the first upper mold base via an additional elastic element; the pipe-expanding element is provided with a pipe-expanding cavity configured to cooperate with the lower mold core to accomplish the pipe expanding process, and the additional elastic element penetrates through the pipe-pressing element; wherein during the closing process of the first upper mold and the lower mold, the pipe-expanding element firstly contacts with the stripper, and the first upper mold gradually closes to the lower mold; the additional elastic element is compressed, and the pipe-pressing element presses downwardly onto the top of the pipe blank to make the bottom of the pipe blank enter a gap defined by the lower mold core and the pipe-expanding element, and the pipe expansion process is achieved.

19. The manufacturing apparatus of claim 17, wherein one end of the necking inner core abutted against the lower mold core is provided with a boss, and an outer contour of the boss is the same as an inner contour of the necked chamfer end of the finished product of the USB interface metal casing; the boss is configured to limit the dimension of the inner contour of the necked chamfer end during the necking and chamfering process performed by the necking element.

20. The manufacturing apparatus of claim 17, wherein the second upper mold includes a middle protection element arranged at a bottom of the necking element, and a side pressing block is arranged inside the middle protection element; the side pressing block is urged to connect to the second upper mold base via an urging block penetrating through the necking element, and is configured to apply side pressure to two sides of the pipe blank during the necking and chamfering processes performed by the necking element, thereby preventing the pipe blank from deforming laterally.

* * * * *